US008911024B2

(12) United States Patent
Fundakowski et al.

(10) Patent No.: US 8,911,024 B2
(45) Date of Patent: Dec. 16, 2014

(54) MILLING DRUM TOOL HOLDER

(75) Inventors: Anne K. Fundakowski, Roseville, MN (US); Benjamin T. Schafer, Elk River, MN (US); Joseph D. Koehler, Dayton, MN (US); David N. Peterson, Brooklyn Park, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 84 days.

(21) Appl. No.: 13/562,955

(22) Filed: Jul. 31, 2012

(65) Prior Publication Data

US 2014/0035345 A1 Feb. 6, 2014

(51) Int. Cl.
*E21C 35/18* (2006.01)

(52) U.S. Cl.
USPC ..... 299/79.1; 299/102; 299/104; 299/105; 299/106; 299/113

(58) Field of Classification Search
CPC ..... E01C 23/12; B28D 1/18; E21C 35/18; E21C 25/10
USPC ..... 299/79.1, 102, 104, 105, 106, 113
See application file for complete search history.

(56) References Cited

U.S. PATENT DOCUMENTS

| | | | | |
|---|---|---|---|---|
| 2,414,559 | A | 1/1947 | Rochlus | |
| 3,801,158 | A | 4/1974 | Radd et al. | |
| 3,866,769 | A | 2/1975 | Morey et al. | |
| 4,205,225 | A | 5/1980 | LeGoff | |
| 5,052,757 | A | 10/1991 | Latham | |
| 5,098,167 | A | 3/1992 | Latham | |
| 6,086,160 | A | 7/2000 | Bitelli | |
| 6,099,081 | A | 8/2000 | Warren et al. | |
| 6,176,552 | B1 | 1/2001 | Topka, Jr. et al. | |
| 6,244,665 | B1 | 6/2001 | Bise et al. | |
| 6,832,818 | B2 | 12/2004 | Luciano | |
| 7,338,134 | B2 | 3/2008 | Latham | |
| 7,357,608 | B2 | 4/2008 | Erickson et al. | |
| 7,520,570 | B2 | 4/2009 | Sansone et al. | |
| 7,883,155 | B2 | 2/2011 | Sollami | |
| 2006/0022510 | A1 | 2/2006 | Sansone et al. | |
| 2008/0035381 | A1 | 2/2008 | Hall et al. | |
| 2008/0088172 | A1 * | 4/2008 | Hall et al. | 299/39.8 |
| 2011/0163591 | A1 | 7/2011 | Sleep et al. | |

OTHER PUBLICATIONS

U.S. Patent Application by Anne K. Fundakowski et al., entitled "Milling Drum Having Integral Tool Mounting Blocks" filed on Jul. 31, 2012.

(Continued)

*Primary Examiner* — John Kreck
*Assistant Examiner* — Carib Oquendo
(74) *Attorney, Agent, or Firm* — Finnegan, Henderson, Farabow, Garrett & Dunner LLP

(57) ABSTRACT

A tool holder is disclosed for use with a milling drum. The tool holder may have a generally cylindrical body defining a first end configured to be received within a tool mounting block of the milling drum, and a second end configured to receive a cutting bit. The tool holder may also have a flange located between the first end and the second end, and a first blind bore initiating at the second end and stopping at the flange such that the generally cylindrical body is substantially solid at the flange. The tool holder may further have at least one sloped surface located at a side of the flange facing the first end of the generally cylindrical body.

20 Claims, 7 Drawing Sheets

(56) References Cited

OTHER PUBLICATIONS

U.S. Design Patent Application by Anne K. Fundakowski et al., entitled "Bit Holder" filed on Jul. 31, 2012.

U.S. Design Patent Application by Anne K. Fundakowski et al., entitled "Mounting Block for Paving Apparatus" filed on Jul. 31, 2012.

* cited by examiner

MILLING DRUM TOOL HOLDER

RELATED APPLICATIONS

This application is based on and claims the benefit of priority from a design patent application entitled "BIT HOLDER" by Anne K. Fundakowski, Benjamin T. Schafer, and David N. Peterson that was filed on Jul. 31, 2012 under Ser. No. 29/428,495, the contents of which are expressly incorporated herein by reference.

This application is also based on and claims the benefit of priority from a design patent application entitled "MOUNTING BLOCK FOR PAVING APPARATUS" by Anne K. Fundakowski, Benjamin T. Schafer, and Joseph D. Koehler that was filed on Jul. 31, 2012 under the Ser. No. 29/428,508, the contents of which are expressly incorporated herein by reference.

TECHNICAL FIELD

The present disclosure relates generally to a tool holder and, more particularly, to a tool holder for a milling drum.

BACKGROUND

Asphalt-surfaced roadways have been built to facilitate vehicular travel. Depending upon usage density, base conditions, temperature variation, moisture variation, and/or physical age, the surface of the roadways can eventually become misshapen, non-planar, unable to support wheel loads, or otherwise unsuitable for vehicular traffic. In order to rehabilitate the roadways for continued vehicular use, spent asphalt is removed in preparation for resurfacing.

Cold planers, sometimes also called road mills or scarifiers, are machines that typically include a frame quadrilaterally supported by tracked or wheeled drive units. The frame provides mounting for an engine, an operator's station, and a milling drum. The milling drum, fitted with cutting tools, is rotated through a suitable interface by the engine to break up the surface of the roadway.

In a typical configuration, multiple spiraling rows of cutting tools are oriented on an external surface of the milling drum to converge at a center of the drum. Each row of cutting tools includes a flighting and a plurality of cutting bits connected to the flighting by individual mounting blocks. In some configurations, the flighting is a continuous helical screw. In other configurations, the flighting is formed by individual segments of a helical screw, one segment for each mounting block. The flighting is welded to the external surface of the milling drum at a precise location and in a precise orientation, such that rotation of the milling drum results in desired movement of removed roadway material from the drum onto the center of a tandem conveyor. In addition, each mounting block is welded at a precise location and in a precise orientation onto a corresponding flighting such that the cutting bits are held in optimal positions that productively remove material while providing longevity to the tools. An exemplary milling drum is disclosed in U.S. Pat. No. 7,520,570 of Sansone et al. that issued on Apr. 21, 2009.

Through use of the milling drum, the tool holders can be damaged or broken. If broken at a point inside of the associated tool mounting block, the broken tool holder can be difficult to remove and replace. Unfortunately, this difficulty can result in high repair costs and cause the machine to be unavailable for use for an extended period of time.

The tool holder and milling drum of the present disclosure solve one or more of the problems set forth above and/or other problems in the art.

SUMMARY

In one aspect, the present disclosure relates to a tool holder for a milling drum. The tool holder may include a generally cylindrical body defining a first end configured to be received within a tool mounting block of the milling drum, and a second end configured to receive a cutting bit. The tool holder may also include a flange located between the first end and the second end, and a first blind bore initiating at the second end and stopping at the flange such that the generally cylindrical body is substantially solid at the flange. The tool holder may further include at least one sloped surface located at a side of the flange facing the first end of the generally cylindrical body.

In another aspect, the present disclosure may be related to another tool holder for a milling drum. This tool holder may include a generally cylindrical body defining a first tapered end configured to be received within a tool mounting block of the milling drum, and a second end configured to receive a cutting bit. The tool holder may also have a flange located between the first tapered end and the second end, and a first bore initiating at the second end and extending toward the flange. The tool holder may further have at least one sloped surface located at a side of the flange facing the first end of the generally cylindrical body. The at least one sloped surface may extend radially outward from an outer surface at the first end to a periphery of the flange.

In another aspect, the present disclosure may be related to yet another tool holder for a milling drum. This tool holder may include a generally cylindrical body defining a first tapered end configured to be received within a tool mounting block of the milling drum, and a second end configured to receive a cutting bit. The tool holder may also include a flange located between the first tapered end and the second end, and a first bore initiating at the second end and extending toward the flange. The tool holder may further include a necked-down area adjacent the flange at the second end. The diameter of the necked-down area may be smaller than a diameter of the generally cylindrical body at an opposing side of the flange.

DETAILED DESCRIPTION

Figure 1:
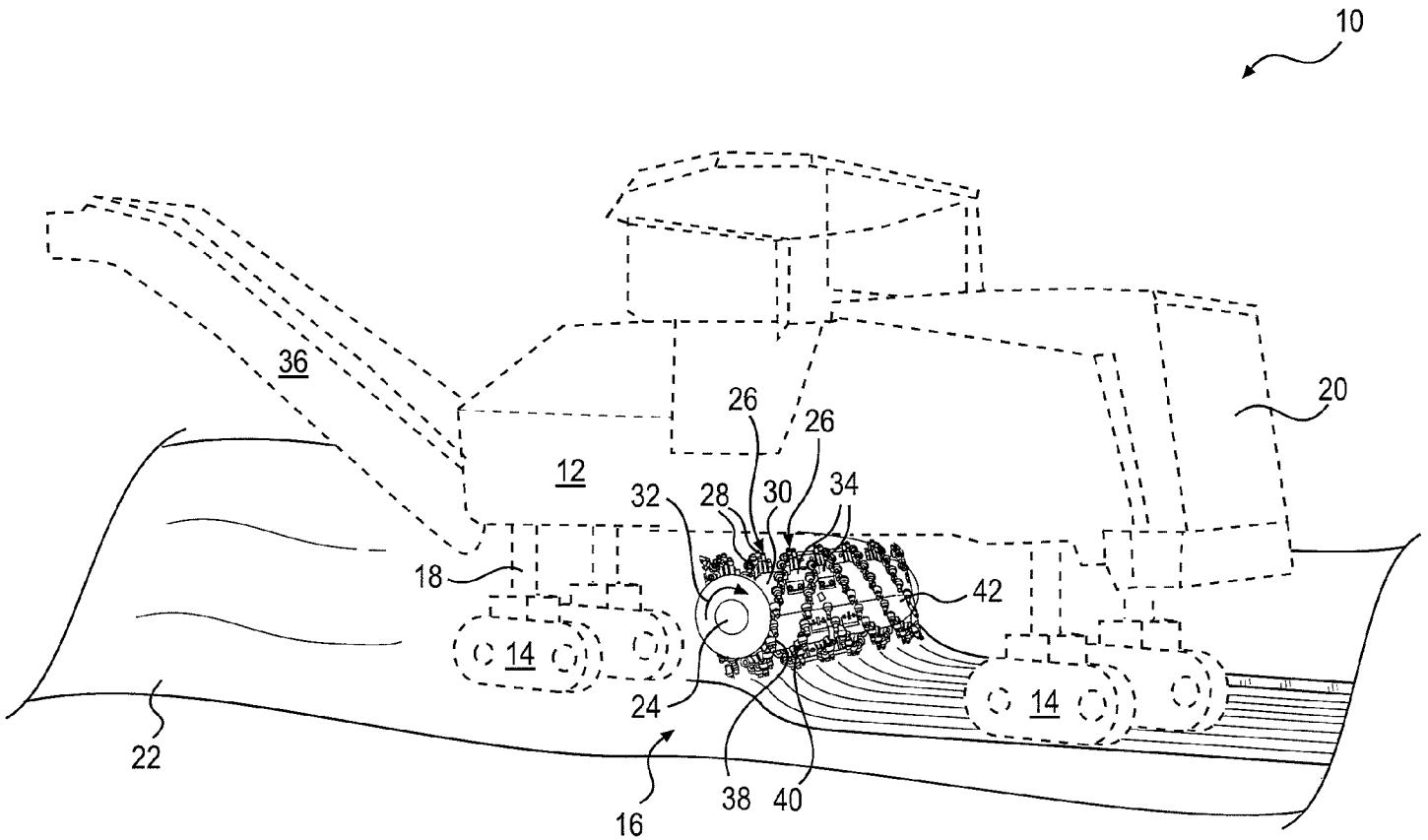
FIG. 1 is a pictorial illustration of an exemplary disclosed cold planer.

FIG. 1 illustrates an exemplary cold planer 10. Cold planer 10 may include a frame 12 connected to one or more traction units 14, and a milling drum 16 supported from frame 12 at a general center of cold planer 10 between traction units 14. Traction units 14 may each include either a wheel or a track section that is pivotally connected to frame 12 by a lifting column 18. Lifting columns 18 may be adapted to controllably raise, lower, and/or tilt frame 12 relative to the associated traction units 14. An engine 20 (or other power source) may be configured to electrically, mechanically, hydraulically, and/or pneumatically power traction units 14, milling drum 16, and lifting columns 18.

For the purpose of this disclosure, the term "asphalt" may be defined as a mixture of aggregate and asphalt cement. Asphalt cement may be a brownish-black solid or semi-solid mixture of bitumen obtained as a byproduct of petroleum distillation. The asphalt cement may be heated and mixed with the aggregate for use in paving roadway surfaces, where the mixture hardens upon cooling. A "cold planer" may be defined as a machine used to remove layers of hardened asphalt from an existing roadway. It is contemplated that the disclosed cold planer may also or alternatively be used to remove lime-based cement, concrete, and other roadway surfaces, if desired.

Milling drum 16 may include components rotated by engine 20 to fragment and remove chunks of asphalt and/or other material from a roadway surface 22. Specifically, milling drum 16 may include a rotary head 24 having one or more spiraling rows 26 of cutting tools 28 operatively connected to an outer cylindrical surface 30. In the disclosed embodiment, three spiraling rows 26 of cutting tools 28 initiate at each end of rotary head 24 and terminate at a lengthwise center of milling drum 16. It should be noted, however, that a greater or lesser number of rows 26 may be included, if desired. The spiraling configuration of rows 26 may function to migrate fragmented roadway material from the ends of rotary head 24 toward the center thereof as milling drum 16 is rotationally driven by engine 20 in the direction of an arrow 32. One or more paddles 34 may be located at the center of rotary head 24, between rows 26, to transfer the fragmented material onto a nearby conveyor 36.

Rows 26 may be arranged relative to the rotating direction of milling drum 16 such that one side of rows 26 is forced into engagement with the fragmented roadway material by the rotation. That is, each row 26 may have a material engaging first side 38 and a second side 40 that is located opposite from first side 38. Second side 40 may generally not engage the fragmented roadway material. A space 42 may be formed between first side 38 of a first row 26 and second side 40 of an adjacent second row 26. Space 42 may function as a channel for the fragmented material and have a size (e.g., a width) based on, among other things, an axial length of rotary head 24, a number of rows 26, and a spiral rate of rows 26. In general, although rows 26 may spiral along the length of rotary head 24, cutting tools 28 may generally point in a circumferential direction such that parallel surface grooves are created along a length of roadway surface 22. The parallel grooves created within roadway surface 22 may be generally aligned with a travel direction of cold planer 10. It is contemplated, however, that cutting tools 28 (and the resulting grooves in roadway surface 22) could be oriented differently, if desired.

Figure 2:
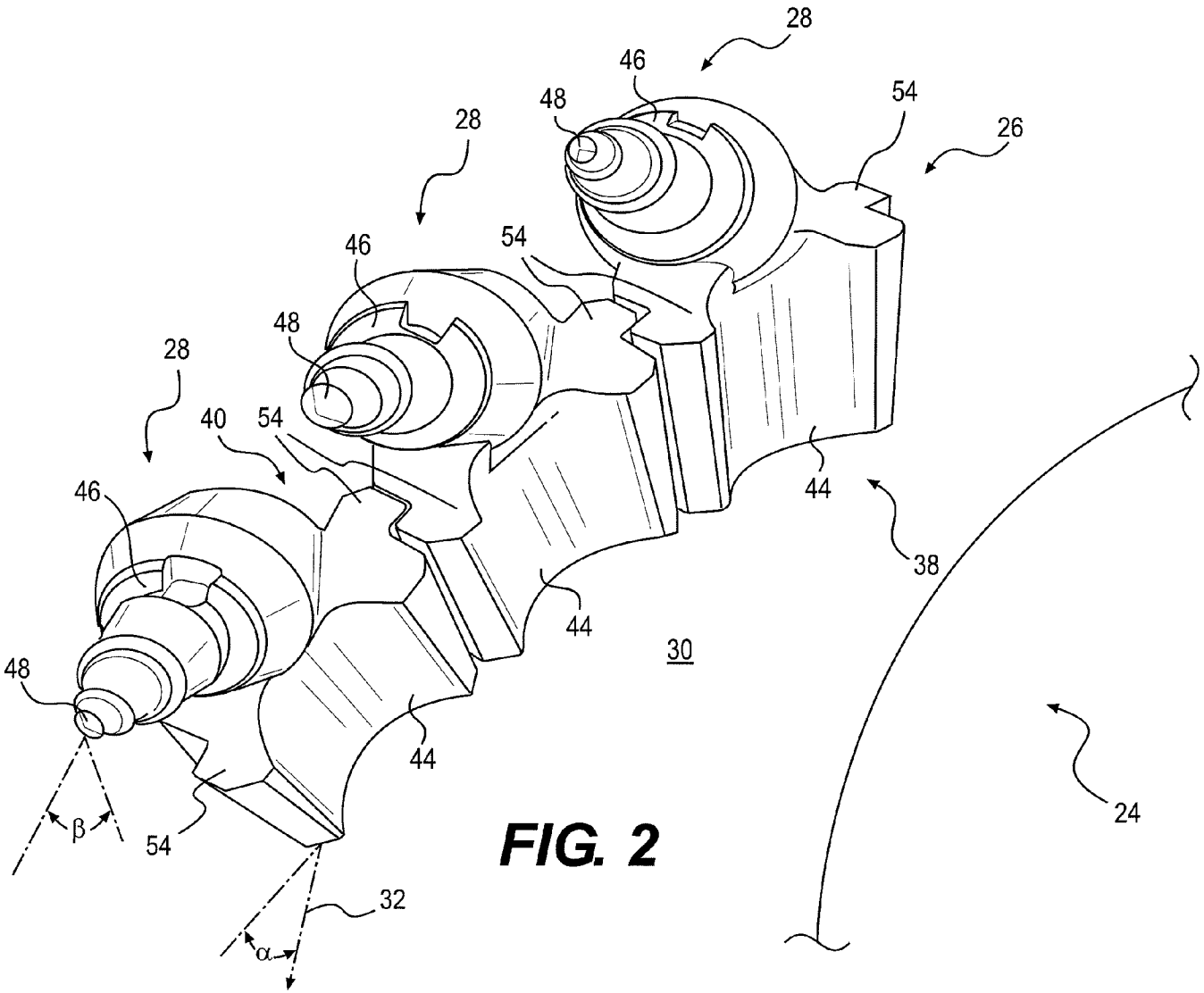
FIG. 2 is a pictorial illustration of exemplary disclosed cutting tools that may be used in conjunction with the cold planer of FIG. 1.
Figure 5:
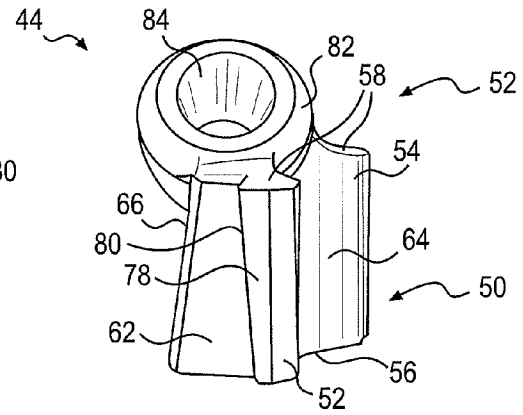
FIGS. 3-8 are pictorial illustrations of an exemplary disclosed tool mounting block that may be used in conjunction with the cutting tools of FIG. 2.
Figure 4:
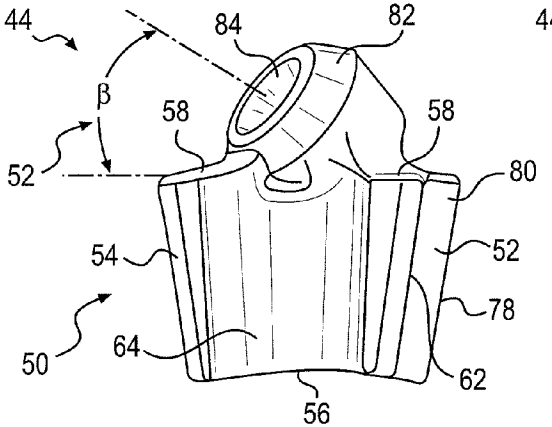

As shown in FIG. 2, each row 26 of cutting tools 28 may be formed by individual mounting blocks 44, tool holders 46, and cutting bits 48. Mounting blocks 44 may be fixedly connected to outer surface 30 of rotary head 24, for example by welding, and configured to removably receive tool holders 46. Each tool holder 46, in turn, may be configured to removably receive one cutting bit 48. The location and arrangement of mounting blocks 44 into rows 26, along with the location and orientation of tool holders 46 within mounting blocks 44, may have an effect on the removal efficiency, productivity, and resulting roadway surface quality produced by cutting bits 48. As will be explained in more detail below, individual mounting blocks 44 may be interlocked with adjacent (e.g., leading and trailing) mounting blocks 44 within the same spiraling row 26, such that the position and orientation of each mounting block 44 on rotary head 24 is determined by the interlocking.

As shown in FIGS. 3-8, each mounting block 44 may include a flighting portion 50, a mounting portion 52, and at least one locating feature 54. Flighting portion 50, mounting portion 52, and locating feature(s) 54 may be integrally formed as a single component. In the disclosed embodiment, mounting block 44 may be formed from a boron alloy through a forging process, although other materials and processes may alternatively be utilized, if desired. Mounting block 44 may have a hardness of about Rockwell 45-48 C.

Flighting portion 50 may be generally block-like and configured to engage outer surface 30 of rotary head 24 (referring to FIGS. 1 and 2). Flighting portion 50 may have a length direction, a width direction, and a height direction. The length direction of flighting portion 50 may generally align with the spiraling direction of rows 26, while the width direction may be generally transverse to the length direction. The height direction may be generally aligned with a radial direction of rotary head 24 and orthogonal to the length and width directions. Flighting portion 50 may include a base surface 56, an upper surface 58 located opposite base surface 56, a leading end surface 60, a trailing end surface 62 located opposite leading end surface 60, a first side surface 64, and a second side surface 66 located opposite first side surface 64. The length direction of flighting portion 50 may generally extend from leading end surface 60 toward trailing end surface 62. The width direction may generally extend from first side surface 64 toward second side surface 66. The height direction may generally extend from base surface 56 to upper surface 58. Leading end surface 60 may join first and second side surfaces 64, 66 at first and second leading corners 68, 70, respectively, while trailing end surface 62 may join first and second side surfaces 64, 66 at first and second trailing corners 72, 74, respectively.

Base surface 56 of each mounting block 44 may be curved in the length direction to generally match the curvature of rotary head 24. That is, base surface 56 may be curved from leading end surface 60 toward trailing end surface 62, and have an axis of curvature (not shown) that extends from first side surface 64 somewhat (e.g., at an oblique angle) toward second side surface 66. The radius of curvature of base surface 56 may generally match the radius of curvature of outer surface 30 of rotary head 24. Because of the spiraling nature of mounting blocks 44, the orientation of the axis of curvature of base surface 56 may be skewed somewhat relative to the length direction. For example, the axis of curvature may be skewed such that each mounting block 44 rests snuggly against outer surface 30 at its spiraled orientation. The angle of this skew will be discussed in more detail below. After assembly to rotary head 24, side edges of base surface 56 may be welded to outer surface 30.

Each mounting block 44 may be configured to engage adjacent mounting blocks 44 at leading and trailing end surfaces 60, 62. In particular, base surface 56 may have a length shorter than a length of upper surface 58, such that leading and trailing end surfaces 60, 62 taper inward from upper surface 58 to base surface 56 (shown in FIGS. 4 and 6). In this configuration, mounting blocks 44 may fit together like wedges in an arch around outer surface 30 of rotary head 24, each mounting block 44 supporting the adjacent mounting blocks 44 along the entire height of leading and trailing end surfaces 60, 62. After assembly, mounting blocks 44 may be welded to each other at upper transverse edges of leading and trailing end surfaces 60, 62. In some embodiments, mounting blocks 44 may also be welded to each other along a height of first and second, leading and trailing corners 68-74.

First side surfaces 64 of flighting portions 50 within adjacent mounting blocks 44 may together form first side 38 of rows 26. Due to the spiraling configuration of rows 26, first side surfaces 64 may be moved to engage fragmented roadway material within space 42 by the rotation of rotary head 24. As first side surfaces 64 engage the fragmented material, the material may deflect off first side surfaces 64 and be conveyed by the deflection toward a center of rotary head 24. That is, each first side surface 64, and in fact each flighting portion 50 of each mounting block 44 in general, may be angled relative to the rotational or circumferential direction of rotary head 24, and the angle may result in the desired deflection. In the disclosed embodiment, each flighting portion 50 may be oriented at an interior angle $\alpha$ of about 5-10° (shown in FIG. 2) relative to the rotational or circumferential direction of rotary head 24. In the disclosed embodiment, the skew of the curvature in base surface 56 (described above) may be about equal to the angle $\alpha$ (shown in FIG. 7), such that the curvature in base surface 56 matches the curvature of rotary head 24. First side surface 64 of each flighting portion 50, like base surface 56, may also be generally curved in the length direction (i.e., first side surface 64 may be concave). This concavity may help reduce an amount of material contained within mounting block 44 and, hence, a weight of each mounting block 44. It is contemplated, however, that first side surface 64 could have another contour (e.g., flat or convex), if desired.

Figure 3:
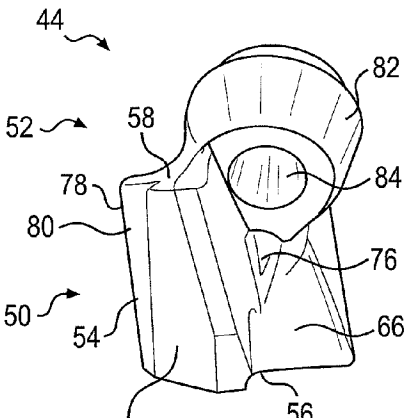
Figure 8:
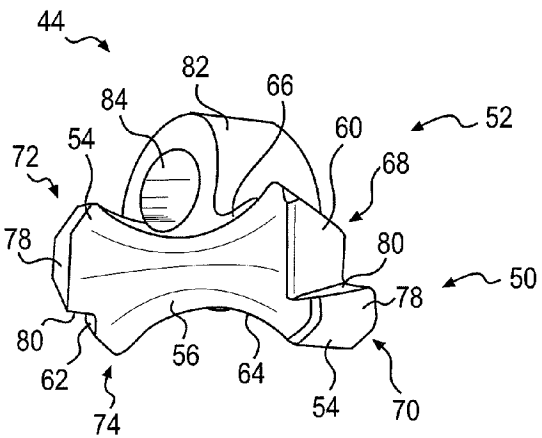
Figure 7:
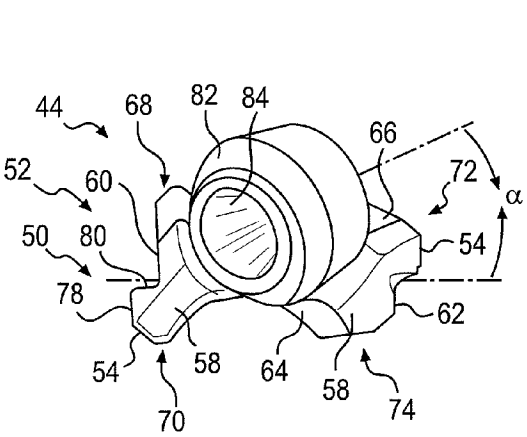
Figure 6:
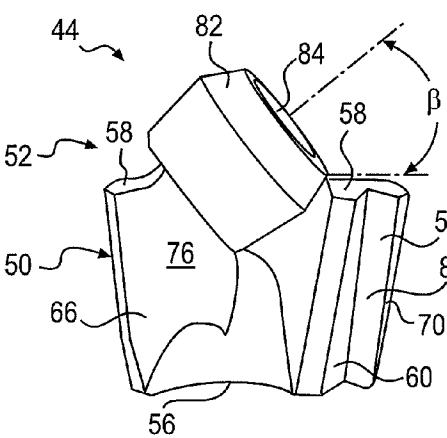
Figure 10:
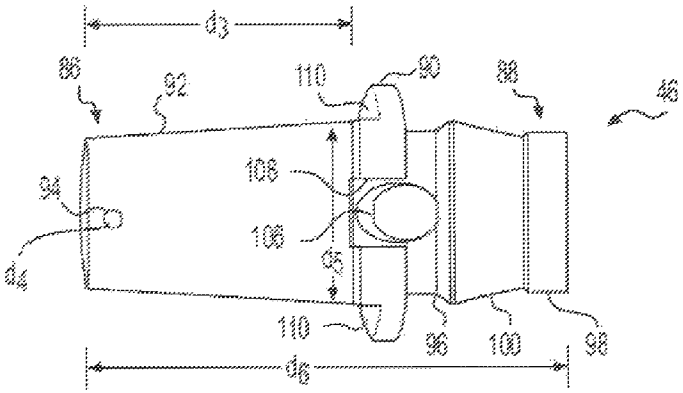
FIGS. 9-13 are pictorial and cross-sectional illustrations of an exemplary disclosed tool holder that may be used in conjunction with the cutting tools and the tool mounting blocks of FIGS. 2-8.
Figure 11:
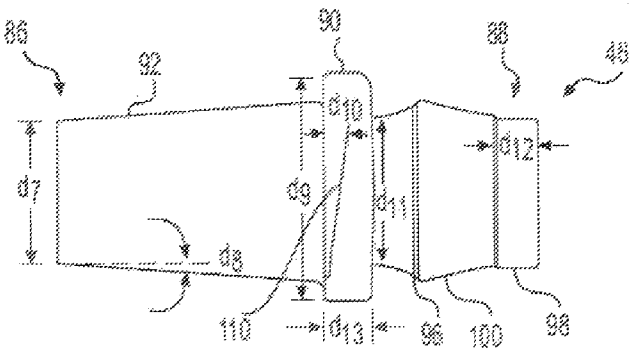
Figure 9:
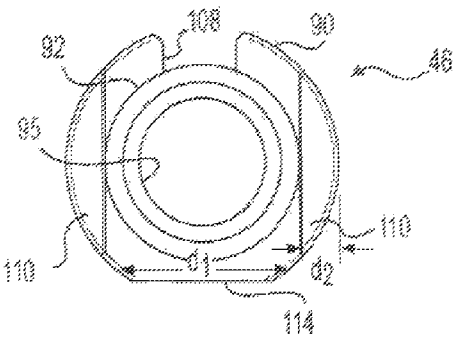
Figure 12:
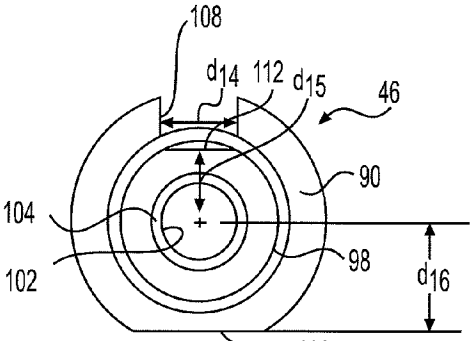
Figure 13:
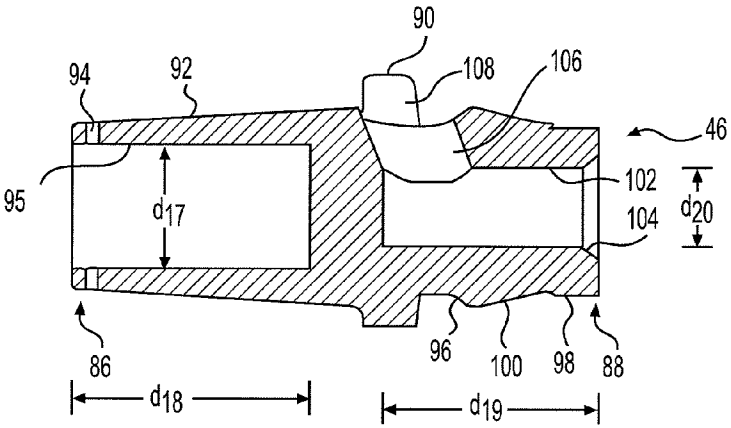

Second side 66 of each flighting portion 50 may include a recess 76 (shown in FIGS. 3 and 6). Recess 76 may be located at a lower or interior axial end of mounting portion 52. In this location, recess 76 may provide access to cutting bit 48 (referring to FIG. 2), allowing a service technician to pry or press against the end of a broken, damaged, or worn tool holder 46 to dislodge the tool holder 46 from mounting block 44. In general, second side surface 66 may not need to be as smooth or continuous as first side surface 64, as second side surface 66 may not typically function as a deflecting means for fragmented roadway material. That is, second side 66 may face away from the fragmented material and, accordingly, have any desired contour.

In the disclosed configuration, two locating features 54 are integrally formed with each mounting block 44. Locating features 54 may be oriented in a general zigzag configuration (see, for example, FIG. 2) at opposing corners of flighting portion 50 (e.g., at first leading corner 68 and second trailing corner 74 or at second leading corner 70 and first trailing corner 72) to engage the end surfaces (leading and trailing end surfaces 60, 62) and locating features 54 of adjacent mounting blocks 44. Specifically, each locating feature 54 may itself include an end surface 78, and an inward-facing side surface 80 that is generally orthogonal to end surface 78. Side surfaces 80 of the two locating features 54 of each mounting block 44 may generally face each other (i.e., face in opposing inward directions). End surfaces 78 of a first mounting block 44 may be configured to engage adjacent leading or trailing end surfaces 60, 62 of adjacent mounting blocks 44, while side surfaces 80 of adjacent mounting blocks 44 may engage each other. With this puzzle-like assembly, tool mounting blocks 44 may be interlocked and thereby constrained from movement in at least two directions (e.g., in a fore/aft direction and in a side-to-side direction). To remove one mounting block 44 from a particular row 26, after grinding or cutting away any associated welds, the particular mounting block 44 may either be lifted directly away from rotary head 24 in a radial direction or twisted (e.g., in a counterclockwise direction) relative to the adjacent mounting blocks 44 and then moved away. Installation of mounting block 44 may be accomplished in reverse manner, followed by welding of circumferential edges that are exposed.

Mounting portion 52 of mounting block 44 may be integrally formed with flighting portion 50 at a side opposite base surface 56 (i.e., at upper surface 58). Mounting portion 52 may be asymmetrically located relative to flighting portion 50, such that mounting portion 52 overhangs only one side of flighting portion 50. In particular, mounting portion 52 may overhang second side 66, away from a potential area of collision with fragmented roadway material at first side 68.

Mounting portion 52 may include a generally cylindrical body 82 having a central bore 84 fabricated therein. An axis of central bore 84 may be generally aligned with the rotational direction of rotary head 24 and, hence, skewed by about angle $\alpha$ relative to the length direction of flighting portion 50. In other words, central bore 84 may be oriented at an oblique angle relative to flighting portion 50, but generally aligned with the circumferential direction of rotary head 24. Central bore 84, as will be described in more detail below, may be configured to receive tool holder 46 (referring to FIG. 2) via a press-fit interference.

Central bore 84 of mounting portion 52 may also be oriented at an oblique attack angle $\beta$ relative to upper and/or base surfaces 56, 58 (e.g., relative to a tangent of outer surface 30 of rotary head 24 at a center of base surface 56). In this orientation, tool holder 46 and cutting bit 48 may be tilted away from rotary head 24 to engage roadway surface 22 in a desired manner. In the disclosed embodiment, attack angle $\beta$ may be an interior angle of about 35-45°.

As shown in FIGS. 9-13, tool holder 46 may be a generally hollow cylindrical member having a first end 86 and an opposing second end 88. First end 86 may be configured for insertion within central bore 84 of mounting portion 52, while second end 88 may be configured to receive cutting bit 48. A flange 90 may be located at a general mid-portion of tool holder 46, between first and second ends 86, 88. In the disclosed embodiment, flange 90 may be located closer to second end 88 than to first end 86, although other arrangements may also be possible. An outer surface 92 of tool holder 46 that extends from flange 90 to first end 86 may be tapered such that a diameter of outer surface 92 at first end 86 is less than an outer diameter at flange 90. In the disclosed embodiment, the outer diameter of surface 92 at flange 90 may be about 48-52 mm, and the taper of outer surface 92 may be about 3-5°. These dimensions may allow for a tight interference fit when tool holder 46 is pressed into mounting portion 52, while also providing shear strength to tool holder 46.

As tool holder 46 is pressed into central bore 84 of mounting portion 52, first end 86 may eventually protrude from the lower axial end of mounting portion 52 in the region of recess 76. In this state, a pin (e.g., a roll pin or a cotter pin—not shown) may be inserted through a cross-hole 94 and extend from opposing sides of outer surface 92 to inhibit separation or exiting of tool holder 46 from mounting portion 52. It should be noted that the pin may be intended primarily to inhibit separation during transport, as opposed to during operation.

First end 86 of tool holder 46 may include a blind bore 95 that stops axially short of flange 90. Blind bore 95 may function to reduce a weight of tool holder 46, while the material located axially between the end of blind bore 95 and flange 90 may enhance a strength of tool holder 46 at flange 90. In the disclosed embodiment, the end wall of blind bore 95 may be located a distance away from flange 90 that is about equal to one-half of the diameter of outer surface 92 at flange 90. It is contemplated, however, that blind bore 95 may end at another location, if desired. It is further contemplated that blind bore 95 may extend an entire length of tool holder 46, if desired.

Second end 88 of tool holder 46 may include a shoulder 96, a generally cylindrical tip end 98, and a tapered outer surface 100 extending between shoulder 96 and tip end 98. Shoulder 96 may mark the end of a "necked-down" area immediately adjacent flange 90. The necked-down area may have an outer diameter smaller than an outer diameter at an opposing side of flange 90 (i.e., smaller than an outer diameter of outer surface 92 at flange 90). This design may allow the necked-down area to function as a stress point intended to break just before breakage of flange 90 or the region between flange 90 and first end 86 can occur. If breakage of tool holder 46 were to occur within mounting portion 52 of mounting block 44, removal of the remaining broken stub of tool holder 46 could prove difficult. Outer surface 100 may function to displace fragmented material out past the periphery of flange 90 and mounting portion 52, thereby increasing the longevity of these components.

Second end 88 may also include a blind bore 102 that is generally aligned with blind bore 95 of first end 86. In the disclosed embodiment, blind bore 102 may extend to an axial location about midway through flange 90, although other depths of blind bore 102 may also be possible. Blind bore 102 may be configured to receive cutting bit 48, and have an internal chamfer 104 at an open end thereof to ease assembly of cutting bit 48 into tool holder 46. Blind bore 102 may have a diameter sized to receive cutting bit 48 via a press-fit interference. It should be noted that, in the disclosed embodiment, blind bore 102 does not communicate with blind bore 95 (i.e., tool holder 46 may does have a continuous axial opening) This configuration may increase a strength of tool holder 46 at flange 90. It is contemplated, however, that blind bore 102 could alternatively communicate with blind bore 95, if desired.

A radial opening 106 may pass through a side of tool holder 46 at flange 90 to intersect with a closed end of blind bore 102. Radial opening 106 may provide access to an internal end of cutting bit 48, such that cutting bit 48 may be pried out of tool holder 46 during servicing. In the disclosed embodiment, radial opening 106 may be inclined toward first end 86 to provide greater access and/or pry leverage. It is contemplated, however, that radial opening 106 could alternatively be oriented orthogonally relative to an axis of tool holder 46 or inclined toward second end 88, if desired. Flange 90 may be interrupted (e.g., include a recess 108) at opening 106 to provide clearance for a pry tool (not shown).

Flange 90 may include parallel sloped surfaces 110 (i.e., sloped relative to an axis of tool holder 46) at opposing sides thereof to facilitate removal of tool holder 46 from mounting block 44. Sloped surfaces 110 may be generally lengthwise-aligned with side walls of recess 108 in flange 90, and the area of flange 90 associated with sloped surfaces 110 may be thinnest at the side of tool holder 46 having opening 106. That is, sloped surfaces 110 may be formed within flange 90 and have a greatest depth at the side of tool holder 46 having opening 106. Sloped surfaces 110 may terminate at the mounting block-side of flange 90, and extend sideways and radially outward to a periphery of flange 90. A wedge shaped service tool (not shown) may be forced between tapered outer surfaces 100 and an external end of mounting portion 52 during servicing to force tool holder 46 out of bore 84.

Tool holder 46 may also include a void 112 formed at tip end 98 during fabrication thereof. Void 112 may embody, for example, a flat spot in the otherwise cylindrical outer surface of tip end 98, although void 112 may take other forms if desired. Void 112 may provide clearance to a shoulder of cutting bit 48 that protrudes past the edge of the flat spot. Using this clearance, a service technician may be able to apply force to the shoulder of cutting bit 48 to help remove cutting bit 48 from tool holder 46. For example, a service technician may be able to hammer against the shoulder of cutting bit 48 at void 112 to knock cutting bit 48 loose from tool holder 46.

An additional flattened area 114 may be formed within flange 90 at a side opposite recess 108, and used to ensure proper installation of tool holder 46. Specifically, flattened area 114 may provide clearance for a protruding portion of mounting block 44 (e.g., for upper surface 58) and, when tool holder 46 is turned to an incorrect angle, flange 90 may engage the protruding portion of mounting block 44 and inhibit insertion of tool holder 46 into bore 84 of mounting portion 52. When flattened area 114 is turned to face the protruding portion of mounting block 44, however, no interference may exist and tool holder 46 may slide into bore 84 in a relatively unobstructed manner. When tool holder 46 is assembled correctly within mounting portion 52 of mounting block 44, opening 106 may be exposed and accessible by a service technician. It is contemplated that flattened area 114 may alternatively or additionally be located at other areas of tool holder 46, if desired. For example, flattened area 114 may alternatively or additionally be formed within shoulder 96, if desired.

Cutting bit 48 may have a generally cylindrical body configured to be received within tool holder 46, and include a pointed hardened tip that engages roadway surface 22 during operation. In one example, the tip of cutting bit 48 may be fabricated from tungsten carbide, though other materials may also or alternatively be utilized. Although not shown, cutting bit 48 may also include a spring clip that surrounds the cylindrical body and functions to retain cutting bit 48 within tool holder 46, as is known in the art. In some embodiments, a washer may initially be located around the spring clip to hold the spring clip in a pre-loaded state, the washer then moving during assembly to an end of the spring clip to protect the corresponding tool holder 46 from relative movement of cutting bit 48.

The exemplary embodiment of tool holder 46 that is illustrated in FIGS. 9-13 is labeled with dimensions (d1-d20) corresponding to a particular design of tool holder 46 that has been shown to exhibit acceptable performance characteristics (e.g., durability, fit, strength, flexibility, etc.). Values for these dimensions are provided in the table below:

| Dimension | Value |
|---|---|
| d1 | 50 mm |
| d2 | 10 mm |
| d3 | 73.3 mm |
| d4 | 3 mm |
| d5 | 50 mm |
| d6 | 132.9 mm |
| d7 | 41.03 mm |
| d8 | 3.5 deg |
| d9 | 70 mm |
| d10 | 7.5 deg |

-continued

| Dimension | Value |
|---|---|
| d11 | 44 mm |
| d12 | 12 mm |
| d13 | 14.3 mm |
| d14 | 18.3 mm |
| d15 | 20 mm |
| d16 | 30 mm |
| d17 | 31 mm |
| d18 | 60 mm |
| d19 | 54 mm |
| d20 | 19.8 mm |

Figure 15:
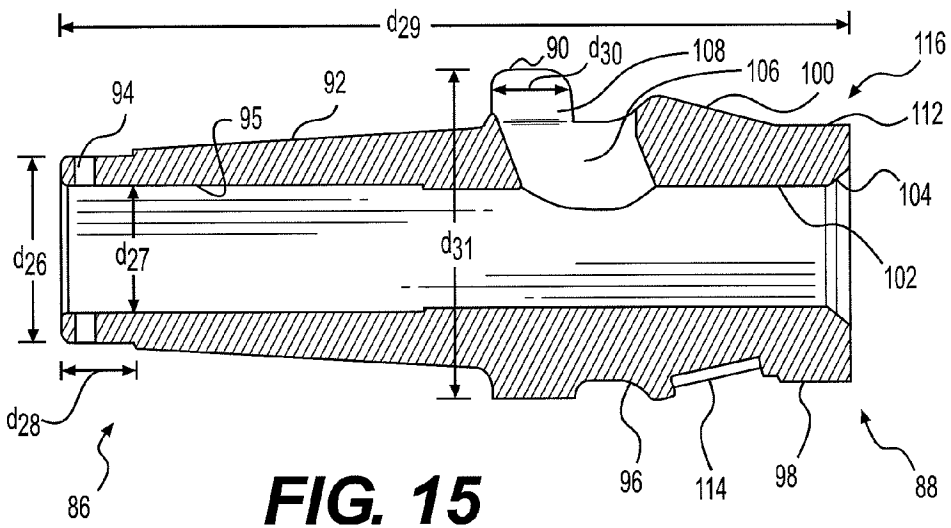
FIGS. 14-16 are pictorial and cross-sectional illustrations of another exemplary disclosed tool holder that may be used in conjunction with the cutting tools and the tool mounting blocks of FIGS. 2-8.
Figure 14:
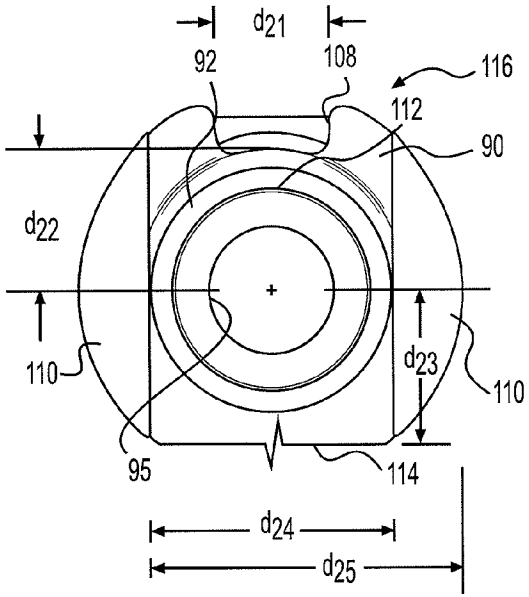
Figure 16:
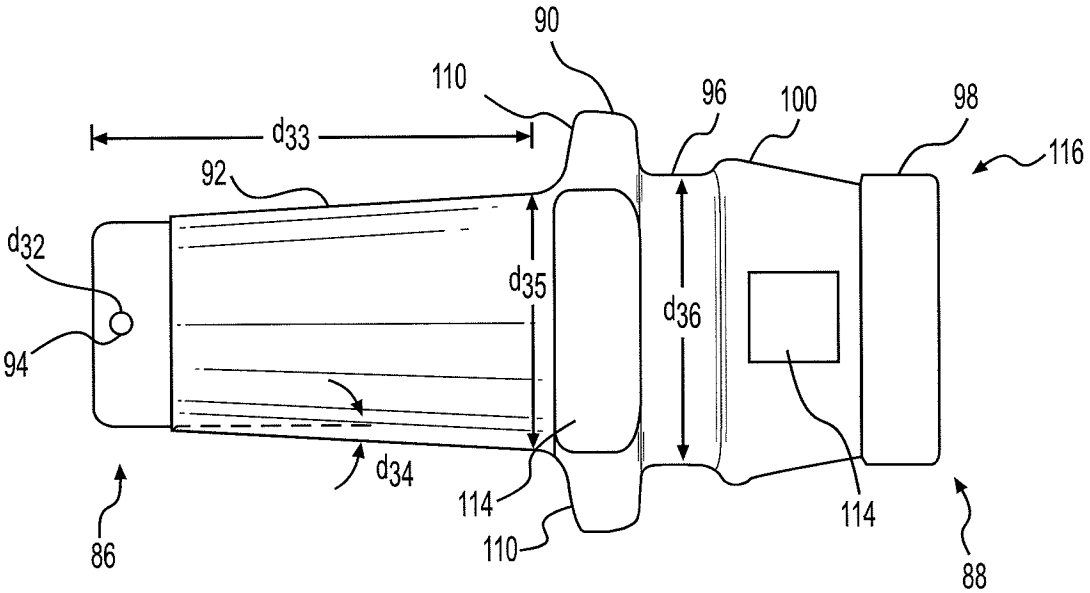

FIGS. 14-16 illustrate an alternative tool holder 116. Tool holder 116, like tool holder 46 may include cylindrical body 82 having first end 86, second end 88, and flange 90 located between first and second ends 86, 88. Tool holder 116 may also include outer surface 92, cross-hole 94, blind bore 95, shoulder 96, outer surface 100, blind bore 102, and chamfer 104. Tool holder 116 may likewise include radial opening 106, recess 108, sloped surfaces 110, and flattened area 114. However, in comparison to tool holder 46, outer surface 92 of tool holder 116 may have a smaller outer diameter at flange 90. In particular, the diameter of outer surface 92 at flange 90 of tool holder 116 may be the same or smaller than the outer diameter at the necked-down on the opposing side of flange 90. In addition, outer surface 92 at first end 86 may have a generally straight portion (i.e., outer surface 92 may not be tapered at first end 86) that facilitates machining of other features of tool holder 116 (e.g., blind bores 95 and 102). Finally, flattened area 114 of tool holder 116 may extend across both a portion of flange 90 (as with tool holder 46) and across a portion of shoulder 96. It is also contemplated that cross-hole 94 of tool holder 116 may have a larger diameter, if desired, to receive a larger size pin.

The exemplary embodiment of tool holder 116 that is illustrated in FIGS. 14-16 is labeled with dimensions (d21-d36) corresponding to a particular design of tool holder 46 that has been shown to exhibit acceptable performance characteristics (e.g., durability, fit, strength, flexibility, etc.). Values for these dimensions are provided in the table below:

| Dimension | Value |
|---|---|
| d21 | 18.3 mm |
| d22 | 20 mm |
| d23 | 25 mm |
| d24 | 41 mm |
| d25 | 52.5 mm |
| d26 | 31 mm |
| d27 | 21 mm |
| d28 | 12.3 deg |
| d29 | 131 mm |
| d30 | 13 mm |
| d31 | 64 mm |
| d32 | 3 mm |
| d33 | 71.4 mm |
| d34 | 3.5 deg |
| d35 | 39.66 mm |
| d36 | 44 mm |

INDUSTRIAL APPLICABILITY

The disclosed tool holder and milling drum may be used within any cold planer for the fragmenting and removal of roadway surface material. The disclosed tool holder and milling drum may improve longevity of machine components, while also decreasing servicing difficulty, time, and expense. Component longevity may be increased through the unique design of the disclosed tool holder that functions to increase a shear strength of the holder. This unique design may include, among other things, a particular outer diameter and a solid center at a flange thereof. The unique design may also include features of the flange itself, for example a contour, size, and location of sloped surfaces in the flange that are used for service of the tool holder. By increasing the shear strength of the disclosed tool holder, it may be less likely that the tool holder will break at an inaccessible location (e.g., within the associated tool mounting block). This improvement may reduce the difficult, time, and expense required to remove and replace a broken tool holder.

To replace a damaged or broken tool holder 46, a pry tool may be inserted between flange 90 and mounting portion 52 of mounting block 44, at sloped surfaces 110. The pry tool may be hammered into this space, thereby creating a force normal to sloped surfaces 110 that urges tool holder 46 out of bore 84 of mounting block 44. Additionally or alternatively, a mallet may be struck against first end 86 of tool holder 46 that protrudes from mounting portion 52 until tool holder 46 is knocked free of mounting block 44. A new tool holder 46 may then be pressed into bore 84 of mounting portion 52.

It will be apparent to those skilled in the art that various modifications and variations can be made to the disclosed tool holder and milling drum without departing from the scope of the disclosure. Other embodiments of the tool holder and milling drum will be apparent to those skilled in the art from consideration of the specification and practice of the tool holder and milling drum disclosed herein. It is intended that the specification and examples be considered as exemplary only, with a true scope of the disclosure being indicated by the following claims and their equivalents.

What is claimed is:

1. A tool holder for a milling drum, comprising:

a generally cylindrical body defining a first end configured to be received within a tool mounting block of the milling drum, and a second end configured to receive a cutting bit;

a flange located between the first end and the second end;

a first blind bore initiating at the second end and stopping at the flange such that the generally cylindrical body is solid at the flange;

at least one generally planar sloped surface located at a side of the flange facing the first end of the generally cylindrical body and extending radially outward in a cross-slope direction from the generally cylindrical body to a periphery of the flange;

a radial opening passing through a wall of the generally cylindrical body to communicate with an internal end of the first blind bore.

2. The tool holder of claim 1, wherein the first blind bore stops at an axial location about midway through the flange.

3. The tool holder of claim 2, further including an internal chamfer located at an open end of the first blind bore.

4. The tool holder of claim 1, further including a second blind bore generally aligned with the first blind bore, initiating at the first end, and stopping axially short of the flange.

5. The tool holder of claim 4, wherein an axial dimension between an internal end of the second blind bore and an internal end of the first blind bore is about equal to one-half of a diameter of the generally cylindrical body at a side of the flange facing the first end.

6. The tool holder of claim 1, wherein the at least one generally planar sloped surface includes two generally planar sloped surfaces located at opposing sides of the generally cylindrical body.

7. The tool holder of claim 1, wherein the radial opening is inclined toward the first end relative to an axis of the generally cylindrical body.

8. The tool holder of claim 7, wherein the flange is interrupted at the radial opening.

9. The tool holder of claim 1, further including a flattened area located at a side of the generally cylindrical body opposite the radial opening, the flattened area being configured to facilitate assembly of the tool holder into the tool mounting block.

10. The tool holder of claim 1, further including a void at the second end of the generally cylindrical body that is configured to provide access to a shoulder of the cutting bit.

11. The tool holder of claim 1, further including a cross-hole passing transversely through the generally cylindrical body at the first end, the cross-hole configured to receive a pin that inhibits separation of the tool holder from the tool mounting block during transportation.

12. The tool holder of claim 1, further including:

a necked-down area adjacent the flange at the second end; and a shoulder located at an end of the necked-down area.

13. The tool holder of claim 12, wherein a diameter of the necked-down area is smaller than a diameter of the generally cylindrical body at an opposing side of the flange.

14. The tool holder of claim 13, wherein the diameter of the generally cylindrical body at the opposing side of the flange is about 48-52 mm.

15. The tool holder of claim 1, wherein the generally cylindrical body tapers from the flange toward the first end by about 3-5°.

16. A tool holder for a milling drum, comprising:

a generally cylindrical body defining a first tapered end configured to be received within a tool mounting block of the milling drum, and a second end configured to receive a cutting bit;

a flange located between the first tapered end and the second end;

a first bore initiating at the second end and extending toward the flange; and a necked-down area adjacent the flange at the second end;

wherein a diameter of the necked-down area adjacent the flange is smaller than a diameter of the generally cylindrical body at an opposing side of the flange.

17. The tool holder of claim 16, wherein an outer diameter of the generally cylindrical body at a side of the flange facing the first tapered end is about 48-52 mm.

18. The tool holder of claim 17, further including:

a flattened area located at a side of the generally cylindrical body opposite the radial opening, the flattened area being configured to ensure proper assembly of the tool holder into the tool mounting block; and a void at the second end of the generally cylindrical body that is configured to provide access to a shoulder of the cutting bit.

19. The tool holder of claim 16, further including a radial opening passing through a wall of the generally cylindrical body at an internal end of the first bore, wherein:

the radial opening is inclined toward the first tapered end relative to an axis of the generally cylindrical body; and the flange is interrupted at the radial opening.

20. A milling drum, comprising:

a head having a cylindrical outer surface;

a plurality of mounting blocks arranged into spiraling rows on the cylindrical outer surface of the head;

a plurality of cutting bits; and a plurality of tool holders operatively connecting the plurality of cutting bits to the plurality of mounting blocks each of the plurality of tool holders including:

a generally cylindrical body defining a first end received within a corresponding one of the plurality of mounting blocks, and a second end configured to receive a corresponding one of the plurality of cutting bits;

a flange located between the first end and the second end;

a first blind bore initiating at the second end and stopping at about an axial midpoint of the flange such that the generally cylindrical body is solid at the flange;

a second blind bore in general alignment with the first blind bore, initiating at the first end, and stopping axially short of the flange;

sloped generally planar surfaces located within the flange at opposing sides of the generally cylindrical body, facing the first end of the generally cylindrical body, and extending radially outward from the generally cylindrical body to a periphery of the flange; and a necked-down area adjacent the flange at the second end, wherein a diameter of the necked-down area adjacent the flange is smaller than a diameter of the generally cylindrical body at an opposing side of the flange.

* * * * *